US008555820B2

(12) United States Patent
Sumi

(10) Patent No.: US 8,555,820 B2
(45) Date of Patent: Oct. 15, 2013

(54) BOILER

(75) Inventor: Soji Sumi, Matsuyama (JP)

(73) Assignee: Miura Co., Ltd., Matsuyama-Shi (JP)

( * ) Notice: Subject to any disclaimer, the term of this patent is extended or adjusted under 35 U.S.C. 154(b) by 462 days.

(21) Appl. No.: 13/072,028

(22) Filed: Mar. 25, 2011

(65) Prior Publication Data

US 2012/0240868 A1 Sep. 27, 2012

(51) Int. Cl.
*F22B 37/10* (2006.01)

(52) U.S. Cl.
USPC ..... 122/235.15; 122/6 A; 122/367.3

(58) Field of Classification Search
USPC ..... 122/235.11, 235.23, 1 B, 235.15, 367.1, 122/367.2, 347, 360
See application file for complete search history.

(56) References Cited

U.S. PATENT DOCUMENTS 4,825,813 A * 5/1989 Yoshinari et al. ..... 122/6 A
6,253,715 B1 * 7/2001 Takubo et al. ..... 122/235.11
6,269,782 B1 * 8/2001 Kayahara et al. ..... 122/235.11
7,827,941 B2 * 11/2010 Sumi ..... 122/235.11
2010/0212603 A1 * 8/2010 Ookubo et al. ..... 122/13.01

FOREIGN PATENT DOCUMENTS

JP 3373127 11/2002
WO 2009/150891 12/2009

* cited by examiner

*Primary Examiner* — Gregory A Wilson
(74) *Attorney, Agent, or Firm* — Fox Rothschild LLP

(57) ABSTRACT

A boiler has a plurality of inner heat-transfer tubes which makes up an inner heat-transfer tube row, and a plurality of outer heat-transfer tubes which makes up an outer heat-transfer tube row. Inner fins project from each of the inner heat-transfer tubes on an outer circumferential side of the inner heat-transfer tube row. Outer fins project from each of the outer heat-transfer tubes on an inner circumferential side of the outer heat-transfer tube row. An inner row communicating portion is provided in a lower end portion of the inner heat-transfer tube row. An outer row communicating portion is provided in an upper end portion of the outer heat-transfer tube row. An inner-fin absent region is provided in a lower end portion of each of the inner heat-transfer tubes. An outer-fin absent region is provided in a longitudinally middle portion of each of the outer heat-transfer tubes.

4 Claims, 6 Drawing Sheets

BOILER

BACKGROUND OF THE INVENTION (1) Field of the Invention

The present invention relates to various types of boilers including a steam boiler, hot-water boiler, a waste-heat boiler, and an exhaust-gas boiler.

(2) Description of the Related Art

A boiler of a conventional multitubular boilers includes a can body constructed by arraying a number of water tubes concentrically and cylindrically between an upper header and a lower header, which are annually formed. In the above-described can body, an inside of an inner water tube row serves as a combustion chamber, and a clearance between the inner water tube row and an outer water tube row serves as a combustion gas path.

Accordingly, when combustion of fuel is performed toward the combustion chamber from a burner installed in an upper portion of the can body, combustion gas reverses in a lower portion of the combustion chamber, and passes between the inner water tube row and the outer water tube row to be exhausted to a flue from the upper portion of the can body as exhaust gas. During this process, the combustion gas performs heat exchange with water inside the respective water tubes, so that the water inside the water tubes is heated. In order to effectively perform the heat transfer to the water inside the water tubes, each of the outer water tubes (and the inner water tubes) is provided with fins to increase a heat-transfer area.

However, it needs to be considered that a combustion gas temperature decreases downstream. For example, in the can body of the above-described boiler, the temperature of the combustion gas flowing upward through the combustion gas path between the inner water tube row and the outer water tube row decreases upward. That is, a lower portion of the combustion gas path is a higher-temperature portion as compared with an upper portion thereof.

Accordingly, merely installing the fins in the same shape at equal vertical intervals in the respective water tubes without considering the above-described situation leads to an increase in heat stress occurring in the fins attached on an upstream side. Particularly, when scale (deposit of hardness in the water) adheres to insides of the water tubes, the heat transfer from the fins to the water inside the water tubes is inhibited, thereby causing a possibility of generating excessive heat stress in the fins. In this case, there is a possibility that the fins are overheated, thereby dropping off or burning out. On the other hand, pressure loss when the combustion gas enters the combustion gas path from the combustion chamber needs to be considered as well.

While, in view of these points, it can be considered that no fins are installed in the high-temperature portion, it is not preferable for efficient heat recovery not to utilize the high-temperature portion. On the other hand, if the fins in an entire region in a vertical direction excluding a small-diameter portion for communicating the inside and the outside of the inner water tube row are provided, or the fins in an entire region in the vertical direction of the outer row water tubes are provided, it may cause too much pressure loss when the combustion gas enters the combustion gas path from the combustion chamber, or may cause too high heat conductivity from the combustion gas to the respective water tubes immediately after the combustion gas turns in a lower portion of the combustion chamber.

SUMMARY OF THE INVENTION

A problem to be solved by the present invention is to alleviate heat stress occurring in fins and to achieve effective heat recovery while reducing pressure loss of the combustion gas.

The present invention is devised in order to solve the above-described problem, and an invention of a first aspect is a boiler including the following components of (a) to (h).

(a) A plurality of inner heat-transfer tubes arrayed cylindrically between an upper header and a lower header and making up an inner heat-transfer tube row.

(b) A plurality of outer heat-transfer tubes arrayed cylindrically between the upper header and the lower header so as to surround the inner heat-transfer tube row and making up an outer heat-transfer tube row.

(c) Inner fins provided so as to project from each of the inner heat-transfer tubes on an outer circumferential side of the cylindrical inner heat-transfer tube row.

(d) Outer fins provided so as to project from each of the outer heat-transfer tubes on an inner circumferential side of the cylindrical outer heat-transfer tube row.

(e) An inner row communicating portion provided in a lower end portion of the inner heat-transfer tube row, and communicating an inside and an outside of the inner heat-transfer tube row.

(f) An outer row communicating portion provided in an upper end portion of the outer heat-transfer tube row, and communicating an inside and an outside of the outer heat-transfer tube row.

(g) An inner-fin absent region that is a region where the inner fins are absent, and is provided in a lower end portion of each of the inner heat-transfer tubes and up to a portion above an upper end of the inner row communicating portion.

(h) An outer-fin absent region that is provided in a longitudinally middle portion of each of the outer heat-transfer tubes, and is a region where the outer fins are absent, the longitudinally middle portion being arranged at a height corresponding to the upper end of the inner row communicating portion.

According to the invention of the first aspect, in each of the inner heat-transfer tubes, a height region corresponding to the inner row communicating portion and a set region thereabove are the inner-fin absent region, and in each of the outer heat-transfer tubes, set regions above and below the height corresponding to the upper end of the inner row communicating portion are the outer-fin absent region. In the above-described constitution, since the fins are not provided in an inflow portion of combustion gas from a combustion chamber (inside of the inner heat-transfer tube row) to a combustion gas path (clearance between the inner heat-transfer tube row and the outer heat-transfer tube row), heat conductivity from the combustion gas to the respective heat-transfer tubes immediately after the combustion gas turns in a lower portion of the combustion chamber can be prevented from becoming too high, and pressure loss of the combustion gas can be reduced. On the other hand, by providing the fins in the regions other than the inflow portion from the combustion chamber to the combustion gas path, particularly in a bottom region of the outer heat-transfer tube, heat recovery can be achieved maximally.

An invention of a second aspect is the boiler according to the first aspect, wherein the inner-fin absent region is a height region corresponding to the inner row communicating portion and a region above the upper end of the inner row communicating portion by a first set distance, the first set distance is a distance 2 to 10 times an installation pitch of the inner fins in a bottom portion, the outer-fin absent region is a region above the height corresponding to the upper end of the inner row communicating portion by a second set distance, and a region shorter than the second set distance therebelow, and the second set distance is a distance 2 to 10 times an installation pitch of the outer fins in a bottom portion.

According to the invention of the second aspect, the first set distance and the second set distance are defined to be the distances 2 to 10 times the installation pitches of the respective fins, which can more effectively prevent the heat conductivity from the combustion gas to the respective heat-transfer tubes from becoming too high in the inflow portion from the combustion chamber to the combustion gas path, and can reduce the pressure loss of the combustion gas.

An invention of a third aspect is the boiler according to the second aspect, wherein the inner heat-transfer tubes are each provided with a small-diameter portion in the lower end portion, and outer circumferential surfaces of the adjacent inner heat-transfer tubes, excluding sections of the small-diameter portions, are brought into contact with each other, in the outer heat-transfer tubes, a clearance between the adjacent outer heat-transfer tubes, excluding the upper end portions, is occluded by an occlusion fin along a longitudinal direction, the inner fins are provided so as to be inclined upward along a circumferential direction of the inner heat-transfer tube row, the outer fins are provided so as to be inclined upward along a circumferential direction of the outer heat-transfer tube row, and in the inner fins and the outer fins, a projection length thereof from each of the heat-transfer tubes is set to be smaller in a lower region of the heat-transfer tube than that in an upper region, and in a region with the same projection length, the installation pitch is set to be larger in the lower region of the heat-transfer tube than that in the upper region.

According to the invention of the third aspect, by making the projection length of the fins smaller and making the installation pitch of the fins larger in the upstream region (high-temperature region) than in the downstream region (low-temperature region) of the combustion gas, variation in a heat-receiving amount per unit length of the heat-transfer tube attributed to a vertical position in each of the heat-transfer tube is reduced. This can alleviate the heat stress occurring in the fins, and enables the effective heat recovery while reducing the pressure loss of the combustion gas.

Furthermore, an invention of a fourth aspect is the boiler according to the third aspect, wherein an installation region of the inner fins in each of the inner heat-transfer tubes and an installation region of the outer fins in each of the outer heat-transfer tubes are each divided into a first region, a second region, a third region and a fourth region from bottom to top, the projection length of the inner fins and the outer fins in the first regions and the second regions is set to be smaller than the projection length in the third regions and the fourth regions, the installation pitch of the inner fins and the outer fins in the first regions and the third regions is set to be larger than the installation pitch in the second regions and the fourth regions, the inner-fin absent region is provided below the first region in each of the inner heat-transfer tubes, and the outer-fin absent region is provided in a vertically middle portion of the first region in each of the outer heat-transfer tubes.

According to the invention of the fourth aspect, each of the heat-transfer tubes is divided into the first region where the relatively short fins are provided at a rough pitch, the second region where the relatively short fins are provided at a fine pitch, the third region where the relatively long fins are provided at the rough pitch, and the fourth region where the relatively long fins are provided at the fine pitch. The inner-fin absent region is provided below the first region in each of the inner heat-transfer tubes, and the outer-fin absent region is provided in the vertically middle portion of the first region in each of the outer heat-transfer tubes. This can prevent the heat conductivity from the combustion gas to the respective heat-transfer tubes immediately after the combustion gas turns in the lower portion of the combustion chamber from becoming too high, and can prevent the pressure loss when the combustion gas enters the combustion gas path from the combustion chamber from becoming too large, which can achieve effective heat recovery.

According to the present invention, the heat stress occurring in the fins can be alleviated, and the effective heat recovery can be achieved while reducing the pressure loss of the combustion gas.

DESCRIPTION OF THE PREFERRED EMBODIMENTS

Hereinafter, a specific embodiment of the present invention will be described with reference to the drawings.

Figure 1:
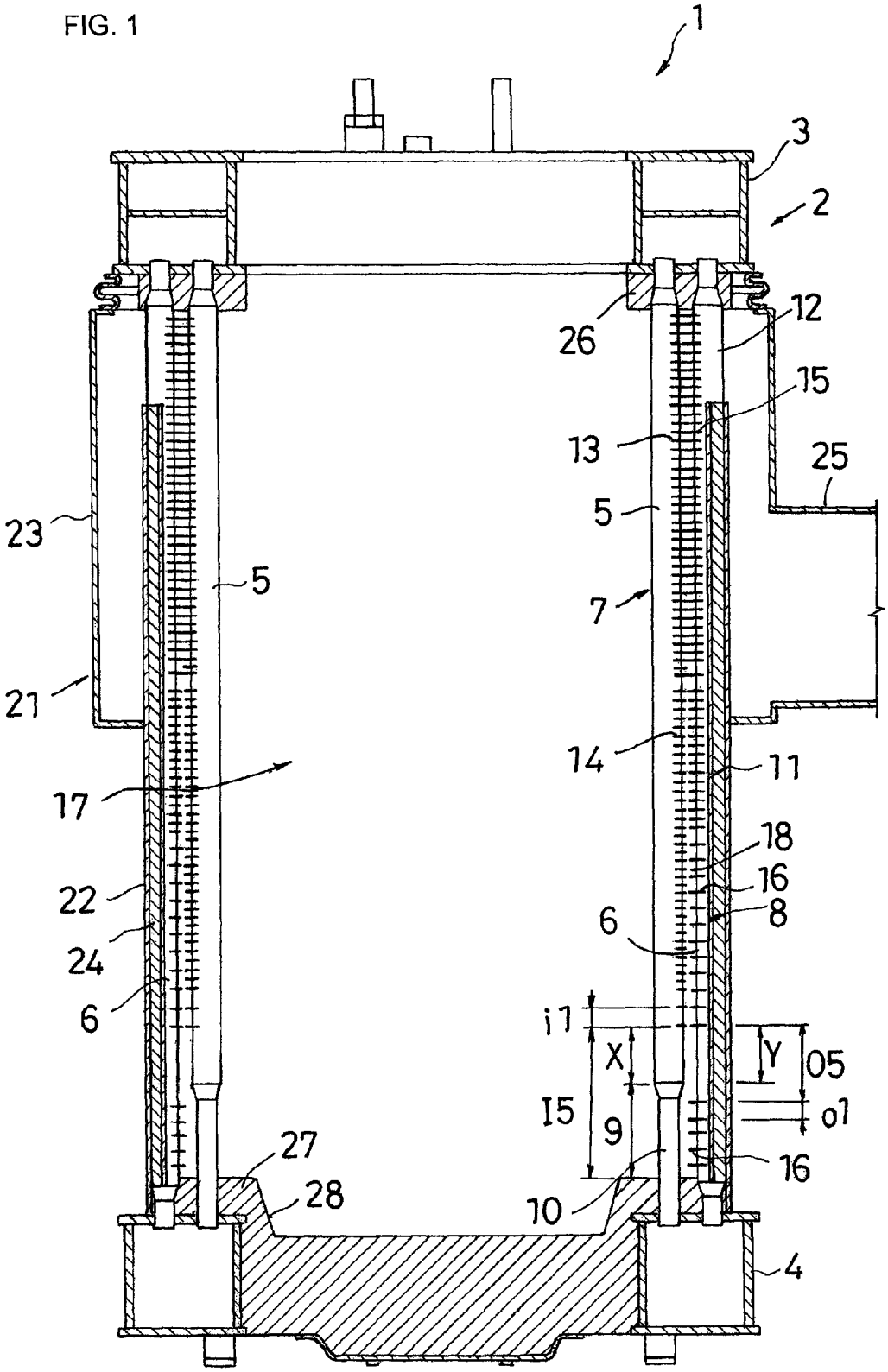
FIG. 1 is a schematic longitudinal cross-sectional view showing one embodiment of a boiler of the present invention.
Figure 2:
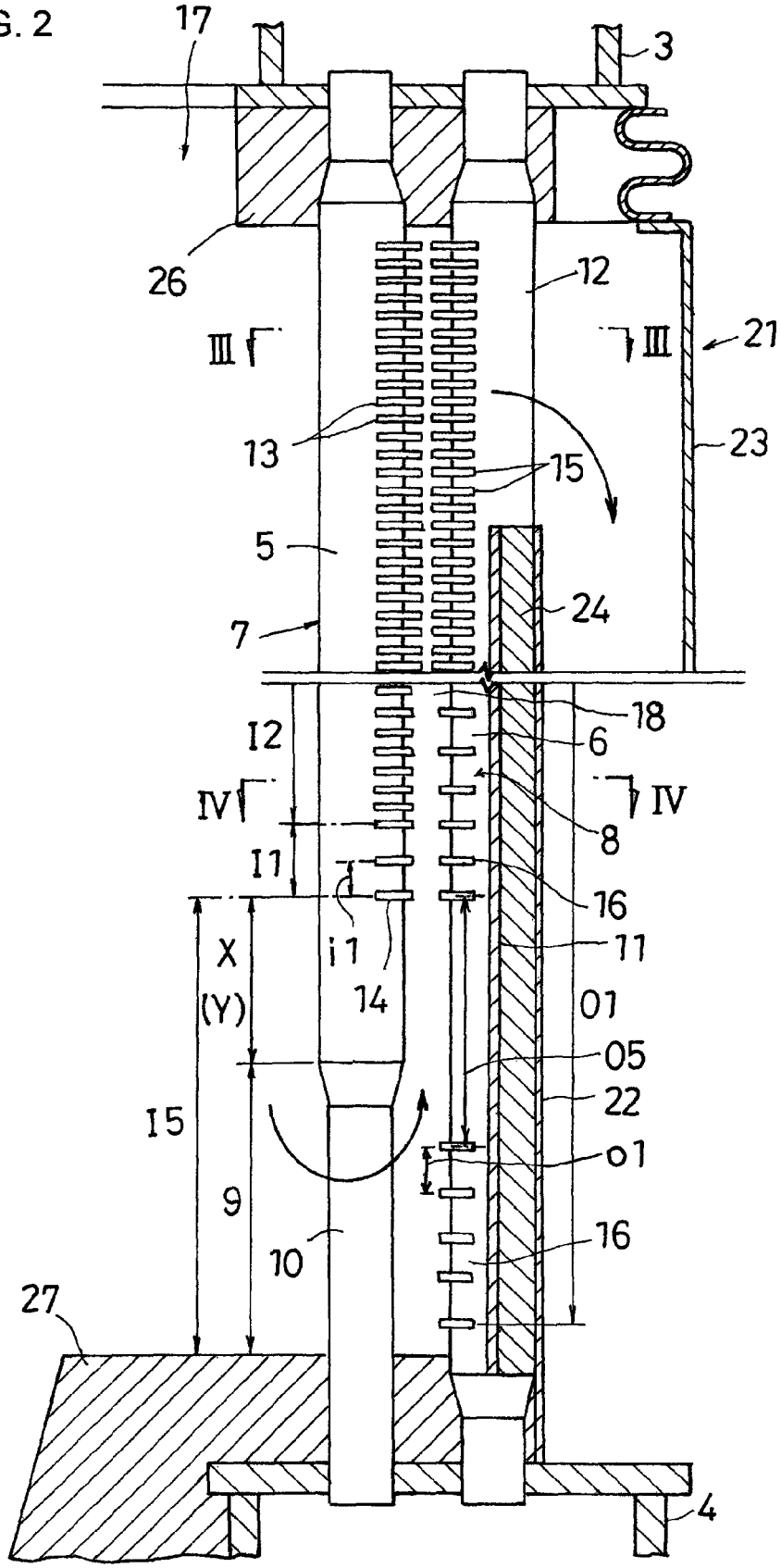
FIG. 2 is an enlarged view of a part of FIG. 1.
Figure 3:
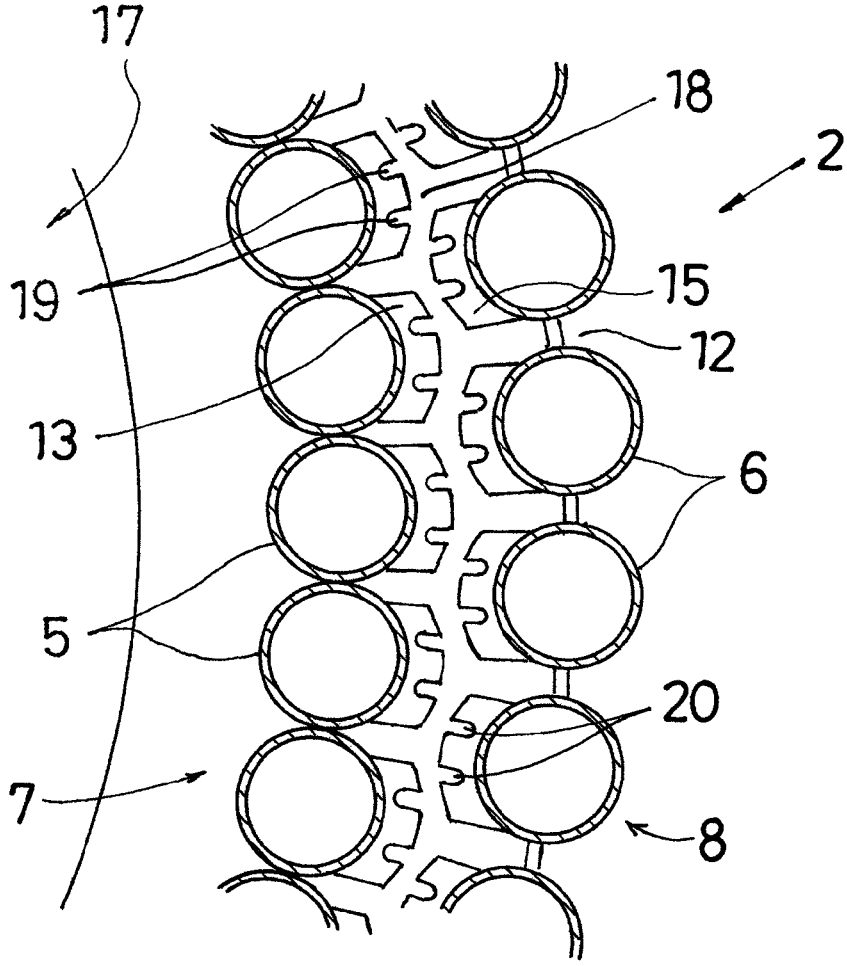
FIG. 3 is a cross-sectional view taken along in FIG. 2.
Figure 4:
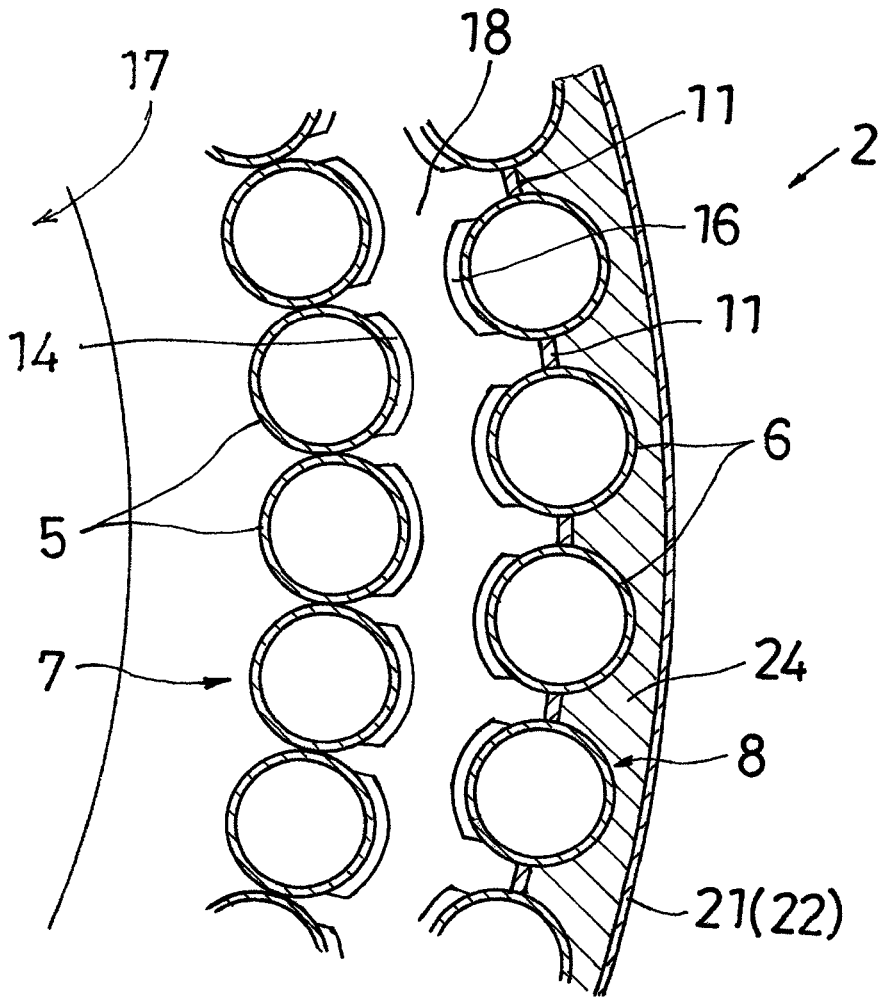
FIG. 4 is a cross-sectional view taken along IV-IV in FIG. 2.

FIG. 1 is a schematic longitudinal cross-sectional view showing one embodiment of a boiler 1 of the present invention. FIG. 2 is an enlarged view of a part of FIG. 1, and FIGS. 3 and 4 are a cross-sectional view taken along and a cross-sectional view taken along IV-IV in FIG. 2, respectively.

The boiler 1 of the present embodiment is a multitubular once-through boiler including a cylindrical can body 2. The can body 2 is constructed by connecting a number of water tubes (heat-transfer tubes) 5, 5, . . . , 6, 6, . . . arrayed cylindrically between an upper header 3 and a lower header 4.

The upper header 3 and the lower header 4 are arranged in parallel at a vertical distance from each other, and are each formed into a hollow annular shape. Moreover, the upper header 3 and the lower header 4 are respectively arranged horizontally on the same axis.

The respective water tubes 5, 6 are arranged vertically, upper end portions of which are connected to the upper header 3, and lower end portions of which are connected to the lower header 4. The respective water tubes 5, 6 are sequentially arrayed in a circumferential direction of the upper header 3 and the lower header 4, by which cylindrical water tube rows 7, 8 are made up. In the present embodiment, the inner water tube row 7 and the outer water tube row 8 are arranged concentrically and cylindrically. The inner water tube row 7 is made up of the inner water tubes 5, 5, . . . arrayed cylindrically. On the other hand, the outer water tube row 8 is made up of the outer water tubes 6, 6, . . . arrayed cylindrically so as to surround the inner water tube row 7.

As shown in FIGS. 3 and 4, the inner water tubes 5 and the outer water tubes 6 are arranged alternately along the circumferential direction of the can body 2. That is, in plan view of the can body 2, each of the outer water tubes 6 is arranged on a line bisecting an angle formed by lines connecting a common center of the both water tube rows 7, 8, which are arranged concentrically, and respective centers of the adjacent inner water tubes 5, 5.

In each of the inner water tubes 5, a set region in the lower end portion is a small-diameter portion 9, and sections excluding these small-diameter portions 9 of the adjacent inner water tubes 5, 5 are brought into contact with each other on outer circumferential surfaces thereof. However, the adjacent inner water tubes 5, 5, excluding the set regions in the lower end portions, may be brought into contact with each other not directly on the outer circumferential surfaces thereof, but with an occlusion fin interposed. In either way, in the inner water tube row 7, a clearance is produced between the adjacent inner water tubes 5, 5 in the lower end portions. An inside and an outside of the inner water tube row 7 are communicated with each other through an inner row communicating portion 10 made up of these clearances.

On the other hand, the adjacent outer water tubes 6, 6 are arranged at a distance from each other, and a clearance between the adjacent outer water tubes 6, 6 is occluded by an occlusion fin 11, excluding set regions of the upper end portions thereof. However, in each of the outer water tubes 6, the set region in the upper end portion may be a small-diameter portion, and the adjacent outer water tubes 6, 6, excluding the sections of these small-diameter portions, may be brought into contact with each other directly on outer circumferential surfaces. In either way, in the outer water tube row 8, the clearance is produced between the adjacent outer water tubes 6, 6 in the upper end portion. An inside and an outside of the outer water tube row 8 are communicated with each other through an outer row communicating portion 12 made up of these clearances.

Figure 5:
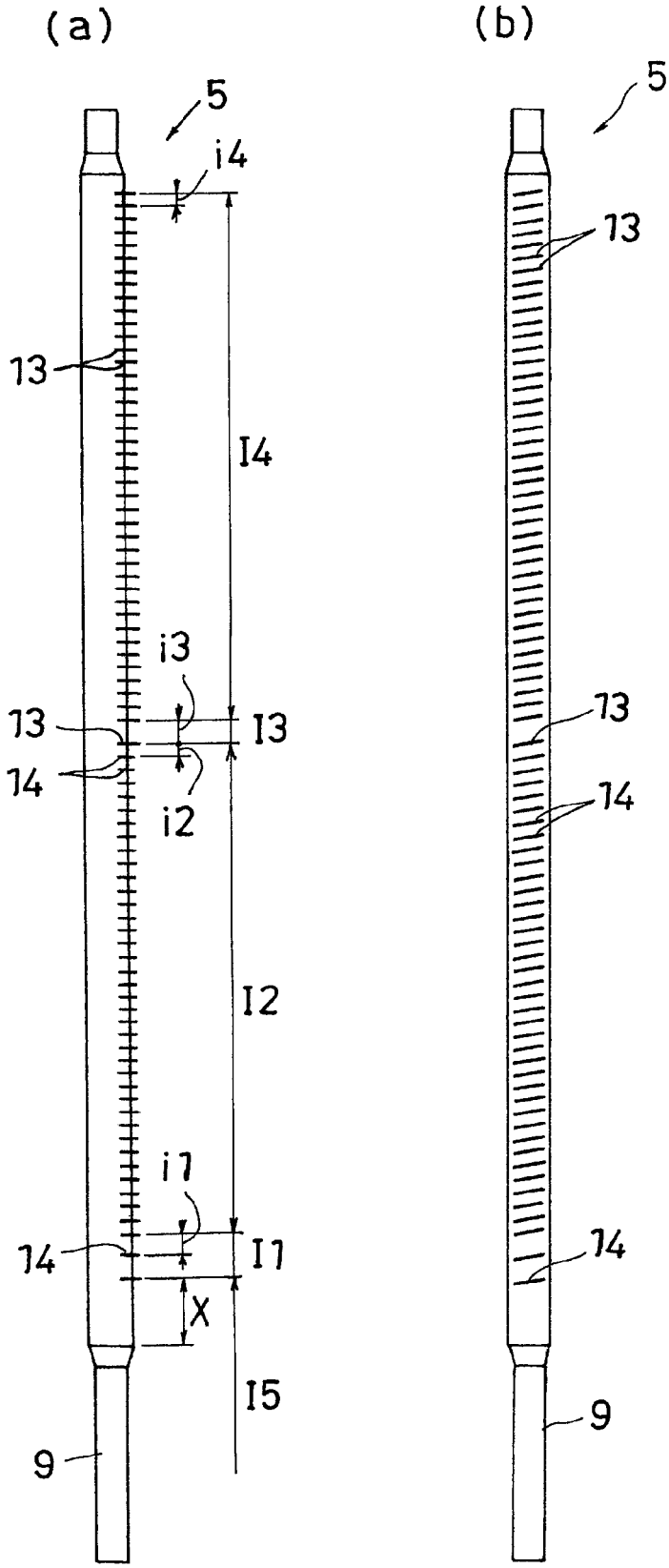
FIGS. 5A and 5B are views showing an inner water tube of the boiler in FIG. 1, FIG. 5A being a front view, and FIG. 5B being a right side view.
Figure 6:
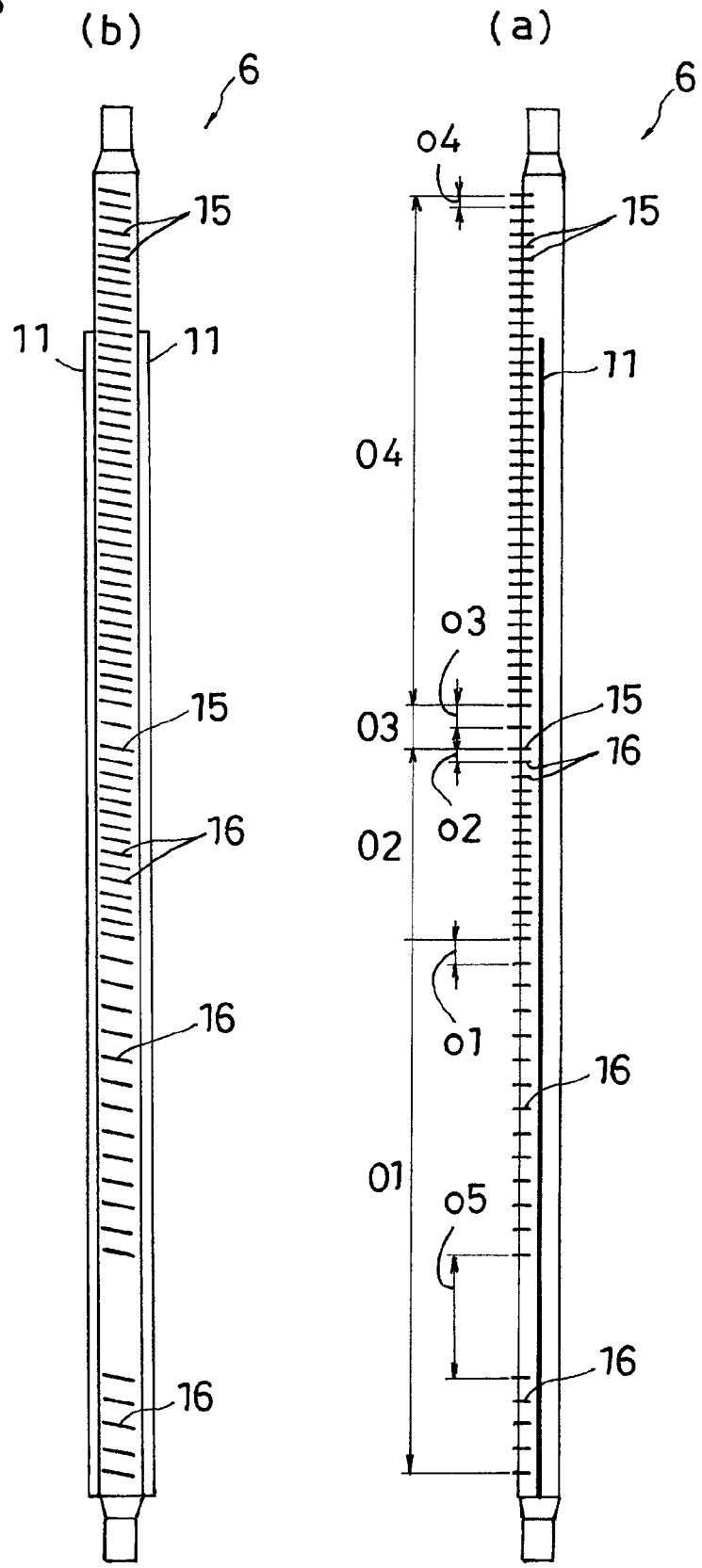
FIGS. 6A and 6B are views showing an outer water tube of the boiler in FIG. 1, FIG. 6A being a front view, and FIG. 6B being a left side view.

FIGS. 5A and 5B are views showing the inner water tube 5, FIG. 5A being a front view, and FIG. 5B being a right side view, wherein FIG. 5A corresponds to a state shown in FIG. 1 and FIG. 5B corresponds to a state when the inner water tube 5 is viewed from an outer circumferential side of the inner water tube row 7. FIGS. 6A and 6B are views showing the outer water tube 6, FIG. 6A being a front view, and FIG. 6B being a left side view, wherein FIG. 6A corresponds to a state shown in FIG. 1 and FIG. 6B corresponds to a state when the outer water tube 6 is viewed from an inner circumferential side of the outer water tube row 8.

In each of the water tubes 5, 6, fins 13 to 16 as extended heat-transfer surfaces are provided. These fins 13 to 16 are provided so as to make smaller a heat-transfer area per unit length of each of the water tubes 5, 6 in an upstream region of the combustion gas than that in a downstream region. In the present embodiment, the combustion gas from a combustion chamber 17 inside the inner water tube row 7 is derived to a combustion gas path 18 between the inner water tube row 7 and the outer water tube row 8 through the inner row communicating portion 10 to go upward, and thus, in each of the water tubes 5, 6, an upper region thereof is the downstream region of the combustion gas, and a lower region is the upstream region of the combustion gas. Accordingly, in the present embodiment, the fins 13 to 16 are provided so as to make smaller the heat-transfer area per unit length of each of the water tubes 5, 6 in the lower region of each of the water tubes 5, 6 than that in the upper region.

Specifically, the fins 13 to 16 are installed with an installation pitch between the vertically adjacent fins and/or a projection length from each of the water tubes 5, 6 changed. Typically, in order to reduce differences in a heat-receiving amount per unit length of each of the water tubes 5, 6 attributed to a vertical position in each of the water tubes 5, 6, the fins 13 to 16 are installed so as to make smaller the projection length from each of the water tubes 5, 6 in the lower region of each of the water tubes 5, 6 than that in the upper region, and when the projection length is the same, the fins 13 to 16 are installed so as to make larger the installation pitch in the lower region of each of the water tubes 5, 6 than that in the upper region.

More specifically, in the respective inner water tubes 5, the inner fins 13, 14 are provided in the surfaces making up an outer circumferential surface of the inner water tube row 7. The inner fins 13, 14 are provided so as to project outward in a radial direction of the inner water tubes 5 like a flange. At this time, in each of the inner water tubes 5, the inner fins 13, 14 are installed at a vertical distance from one another in a region excluding a height region corresponding to the section where the inner row communicating portion 10 is formed (the small-diameter portion 9 in the present embodiment), and a region above an upper end of the small-diameter portion 9 by a first set distance X. Since in the height region corresponding to the inner row communicating portion 10 and the region above the upper end of the inner row communicating portion 10 by the first set distance X, the inner fins 13, 14 are not provided, this region is referred to as an inner-fin absent region I5.

In each of the inner water tubes 5, the upper inner fins 13, 13, . . . are provided in the upper region, and the lower inner fins 14, 14, . . . are provided in the lower region. The lower inner fins 14 each have the shorter projection length from the inner water tube 5 than the upper inner fins 13. Moreover, as shown in FIG. 3, the upper inner fins 13 are formed with cut-outs 19, 19 in projected fore-end portions, while as shown in FIG. 4, the lower inner fins 14 are formed without the above-described cut-outs.

On the other hand, in the respective outer water tubes 6, the outer fins 15, 16 are provided in the surfaces making up an inner circumferential surface of the outer water tube row 8. The outer fins 15, 16 are provided so as to project outward in a radial direction of the outer water tubes 6 like a flange. At this time, in each of the outer water tubes 6, the outer fins 15, 16 are installed at a vertical distance from one another in a region excluding a region above a height corresponding to the upper end of the inner row communicating portion 10 (the small-diameter portion 9 of the inner water tube 5 in the present embodiment) by a second set distance Y, and a region shorter than the second set distance Y therebelow. Since in the region above the height corresponding to the upper end of the inner row communicating portion 10 by the second set distance Y, and the region shorter than the second set distance Y therebelow, the outer fins 15, 16 are not provided, this region is referred to as an outer-fin absent region O5.

In each of the outer water tubes 6, the upper outer fins 15, 15, . . . are provided in the upper region, and the lower outer fins 16, 16, . . . are provided in the lower region. The lower outer fins 16 each have the shorter projection length from the outer water tube 6 than the upper outer fins 15. Moreover, as shown in FIG. 3, the upper outer fins 15 are formed with cut-outs 20, 20 in projected fore-end portions, while as shown in FIG. 4, the lower outer fins 16 are formed without the above-described cut-outs.

As described before, the inner water tubes 5 and the outer water tubes 6 are arranged alternately in the circumferential direction of the can body 2. The inner fins 13, 14 and the outer fins 15, 16 are adjusted in size, shape and arrangement so as not to overlap one another in plan view of the can body 2. Moreover, while the inner fins 13, 14 and the outer fins 15, 16 may be installed in a horizontal state, they are preferably installed so as to be inclined upward along the circumferential direction of the can body 2. In the present embodiment, the inner fins 13, 14 and the outer fins 15, 16 are provided so as to be inclined at an identical set angle to the axial direction (vertical direction) of the respective water tubes 5, 6. This inclined angle is set to 80 degrees, for example. In this manner, in the case where the fins 13 to 16 are inclined from the horizontal state, the combustion gas flowing upward through the combustion gas path 18 between the inner water tube row 7 and the outer water tube row 8 can be stirred to increase the heat transfer from the combustion gas to the water tubes 5, 6.

The installation region of the inner fins 13, 14 in each of the inner water tubes 5 is divided into a first region I1, a second region I2, a third region I3 and a fourth region I4 from bottom to top of the inner water tube 5. In the first region I1 and the second region I2, the lower inner fins 14 are provided, respectively, and in the third region I3 and the fourth region I4, the upper inner fins 13 are provided, respectively.

Moreover, the lower end portion of each of the inner water tubes 5, that is below the first region I1, the inner-fin absent region I5 is provided. The inner-fin absent region I5, as described before, is the small-diameter portion 9 and the region above the upper end thereof by the first set distance X. While this first set distance X is set as needed, in the present embodiment, it is a distance 2 to 10 times an installation pitch i1 of the inner fins 14 in a bottom portion (i.e., the largest installation pitch).

The first region I1 and the second region I2 are different in the installation pitch between the vertically adjacent lower inner fins 14, 14. The pitch i1 in the first region I1 is larger than a pitch i2 in the second region I2. Similarly, the third region I3 and the fourth region I4 are different in the installation pitch between the vertically adjacent upper inner fins 13, 13. A pitch i3 in the third region I3 is larger than a pitch i4 in the fourth region I4. Moreover, in the present embodiment, the installation pitches i1, i3 of the fins 14, 13 in the first region I1 and the third region I3 are equal, and the installation pitches i2, i4 of the fins 14, 13 in the second region I2 and the fourth region I4 are equal.

On the other hand, the installation region of the outer fins 15, 16 in each of the outer water tubes 6 is divided into a first region O1, a second region O2, a third region O3 and a fourth region O4 from bottom to top of the outer water tube 6. In the first region O1 and the second region O2, the lower outer fins 16 are provided, respectively, and in the third region O3 and the fourth region O4, the upper outer fins 15 are provided, respectively.

Moreover, in a longitudinally middle portion of each of the outer water tubes 6, more specifically, in the present embodiment, in a longitudinally middle portion of the first region O1, the outer-fin absent region O5 is provided. The outer-fin absent region O5 is arranged in the longitudinally middle portion at the height corresponding to the upper end of the inner row communicating portion 10 (the small-diameter portion 9 of the inner water tube 5). More particularly, the outer-fin absent region O5 is the region above the height corresponding to the upper end of the inner row communicating portion 10 by the second set distance Y, and the region shorter than the second set distance Y therebelow. While this second set distance Y is set as needed, in the present embodiment, it is a distance 2 to 10 times an installation pitch o1 of the outer fins 16 in a bottom portion (i.e., the largest installation pitch). Moreover, in the present embodiment, the "region shorter than the second set distance Y therebelow" is set to be longer than a length of an upper tapered portion of the small-diameter portion 9, and shorter than half of an entire length of the small-diameter portion 9. While in the present embodiment, the second set distance Y is identical to the first set distance X, it may be different as desired.

The first region O1 and the second region O2 are different in the installation pitch between the vertically adjacent lower outer fins 16, 16. The pitch o1 in the first region O1 is larger than a pitch o2 in the second region O2. Similarly, the third region O3 and the fourth region O4 are different in the installation pitch between the vertically adjacent upper outer fins 15, 15. A pitch o3 in the third region O3 is larger than a pitch o4 in the fourth region O4. Moreover, in the present embodiment, the installation pitches o1, o3 of the fins 16, 15 in the first region O1 and the third region O3 are equal, and the installation pitches o2, o4 of the fins 16, 15 in the second region O2 and the fourth region O4 are equal.

The respective regions I1 to I4 of the inner water tubes are vertically out of alignment with the respective regions O1 to O4 of the outer water tubes. This is attributed to the fact that an inner circumferential surface of the inner water tube row 7 serves as the combustion chamber 17, while the outer circumferential surface of the outer water tube row 8 does not serve as a transfer surface, as described later. Moreover, the provision of the small-diameter portions 9 in the inner water tubes 5 results in the vertical misalignment between the respective regions I1 to I4 of the inner water tubes 5 and the respective regions O1 to O4 of the outer water tubes 6.

In the present embodiment, the arrangement is such that the first region O1 of the outer water tubes 6 (in the middle, the outer-fin absent region O5 is present), the first region I1 of the inner water tubes 5, the second region I2 of the inner water tubes 5, the second region O2 of the outer water tubes 6, the third region I3 of the inner water tubes 5 and the third region O3 of the outer water tubes 6, the fourth region I4 of the inner water tubes 5, and the fourth region O4 of the outer water tubes 6 appear in order from bottom to top of the can body 2.

The ranges of the respective regions I1 to I4 of the inner water tubes 5 and the respective regions O1 to O4 of the outer water tubes 6 are set as needed. However, at this time, as described before, the ranges are set so as to reduce the differences in the heat-receiving amount per unit length of each of the water tubes 5, 6 attributed to the vertical position in each of the water tubes 5, 6. Preferably, setting is made such that by further breaking the regions into smaller (further dividing the regions into multiple stages) or the like, the heat-receiving amount per unit length of each of the water tubes 5, 6 becomes constant regardless of the section of the water tube. In other words, a thermal flow rate (heat-receiving amount per unit heat-transfer area) of each of fins 13, 16 is uniformized.

In the present embodiment, the installation pitches i1, o1 of the fins 14, 16 in the first region I1 of the inner water tubes 5 and the first region O1 of the outer water tubes 6 are equal, the installation pitches i2, o2 of the fins 14, 16 in the second region I2 of the inner water tubes 5 and the second region O2 of the outer water tubes 6 are equal, the installation pitches i3, o3 of the fins 13, 15 in the third region I3 of the inner water tubes 5 and the third region O3 of the outer water tubes 6 are equal, and the installation pitches i4, o4 of the fins 13, 15 in the fourth region I4 of the inner water tubes 5 and the fourth region O4 of the outer water tubes 6 are equal. Furthermore, the installation pitches i2, i4, o2, o4 of the fins 13 to 16 in the second regions I2, O2 and the fourth regions I4, O4 are smaller than the installation pitches i1, i3, o1, o3 of the fins 13 to 16 in the first regions I1, O1 and the third regions I3, O3, and for example, are half. As shown in FIG. 1, the inner and outer fins are arranged so as to appear at corresponding heights as much as possible. Moreover, in the present embodiment, as shown in FIG. 2, an upper end of the inner-fin absent region I5 and an upper end of the outer-fin absent region O5 are arranged at the same height, and this height (i.e., the position where the fins 14, 16 start to be attached) is designed in view of a size of the clearance between the inner water tube row 7 and the outer water tube row 8 and an exhaust gas temperature.

A stepped cylindrical can body cover 21 is further provided between the upper header 3 and the lower header 4 so as to surround the outer water tube row 8. The can body cover 21 is made up of an internal cylinder 22 and an external cylinder 23 with a diameter larger than that of the internal cylinder 22. A lower end portion of the internal cylinder 22 is fixed to the lower header 4, and an upper end portion thereof is arranged at a height corresponding to a lower end portion of the outer row communicating portion 12. On the other hand, an upper end portion of the external cylinder 23 is fixed to the upper header 3 and a lower end portion thereof is arranged at a height corresponding to a vertically middle portion of the internal cylinder 22. In this manner, in the can body cover 21, a clearance between the lower header 4 and itself in the lower end portion of the internal cylinder 22 is sealed, and a clearance between the upper header 3 and itself in the upper end portion of the external cylinder 23 is sealed. Moreover, in the lower end portion of the external cylinder 23, a clearance between the internal cylinder 22 and the external cylinder 23 is sealed. Furthermore, a cylindrical clearance between the internal cylinder 22 of the can body cover 21 and the outer water tube row 8 is filled with a heat insulating material 24. A flue 25 is connected to a lower portion of a part in the circumferential direction of the external cylinder 23.

In a lower surface of the upper header 3 and an upper surface of the lower header 4, fire-resistant materials 26, 27 are provided so as to cover connection portions between the respective headers 3, 4 and the water tubes 5, 6. At this time, the fire-resistant material 27 on the lower header 4 side is provided so as to occlude a central portion of the lower header 4 as well. In the central portion of the fire-resistant material 27 on the lower header 4 side, a columnar or circular truncated cone-shaped depressed portion 28 is formed.

In a central portion of the upper header 3, a burner (omitted in the figure) is provided so as to face downward. The fuel is supplied to this burner, and combustion air is supplied from an air blower (omitted in the figure). Operating the burner allows the combustion of the fuel to be performed inside the can body 2. At this time, the inside of the inner water tube row 7 serves as the combustion chamber 17.

The combustion gas caused by the combustion of the fuel in the combustion chamber 17 is derived through the inner row communicating portion 10 to the combustion gas path 18 between the inner water tube row 7 and the outer water tube row 8. The combustion gas goes upward in the combustion path 18, is radially derived from the upper portion of the outer water tube row 8 through the outer row communicating portion 12, is received by the can body cover 21, and is exhausted outside as exhaust gas through the flue 25. During this process, the combustion gas performs heat exchange with the water in the respective water tubes 5, 6 to heat the water in the respective water tubes 5, 6. This enables the steam to be taken out from the upper header 3, and the steam is fed to a steam usage facility (omitted in the figure) through a steam-water separator (omitted in the figure) and the like.

According to the boiler 1 of the present embodiment, in each of the inner water tubes 5, the height region corresponding to the inner row communicating portion 10 and the set region thereabove are the inner-fin absent region I5, and in each of the outer water tubes 6, the set regions above and below the height corresponding to the upper end of the inner row communicating portion 10 are the outer-fin absent region O5. In the above-described constitution, since the fins 13 to 16 are not provided in an inflow portion of the combustion gas from the combustion chamber 17 to the combustion gas path 18, heat conductivity from the combustion gas to the respective water tubes 5, 6 immediately after the combustion gas turns in a lower portion of the combustion chamber 17 can be prevented from becoming too high, and pressure loss of the combustion gas can be reduced. On the other hand, by providing the fins 16 in the regions other than the inflow portion from the combustion chamber 17 to the combustion gas path 18, particularly in the bottom region of the outer water tubes 6, the heat recovery can be achieved maximally.

Moreover, by making larger the installation pitch of the fins 13 to 16, and making smaller the projection length of the fins 13 to 16 in the upstream region (high-temperature region) of the combustion gas than those in the downstream region (low-temperature region), the variation in the heat-receiving amount per unit length of each of the water tubes 5, 6 attributed to the vertical position in each of the water tubes 5, 6 can be reduced. This can alleviate the heat stress occurring in the fins 13 to 16. Moreover, the pressure loss when the combustion gas enters the combustion gas path 18 from the combustion chamber 17 can be reduced.

The boiler 1 of the present invention is not limited to the constitution in the above-described embodiment, but can be modified as needed. For example, while in the above-described embodiment, the example applied to the steam boiler has been described, it can be similarly applied to a hot water boiler and a heating medium boiler. Furthermore, while in the above-described embodiment, when the exhaust gas is introduced inside the inner water tube row 7 in place of providing the burner, a waste-heat boiler and an exhaust-gas boiler can be constituted.

Moreover, the shape, size, installation pitch and the like of the fins 13 to 16 can be modified as needed, as long as a constitution is employed in which the differences in the heat-receiving amount attributed to the vertical position in each of the water tubes 5, 6 are reduced. For example, while in the above-described embodiment, the water tubes 5, 6 are divided into the four regions I1 to I4, O1 to O4, so that the projection length and the installation pitch of the fins 13 to 16 are changed, they may be divided into two or three regions, or conversely, may be divided into five or more regions.

Furthermore, while in the above-described embodiment, the outer-fin absent region O5 is provided in the middle of the first region O1 of the outer water tubes 6, and in the regions vertically adjacent to the outer-fin absent region O5, the outer fins 16 with the same size and installation pitch are provided, the outer fins 16 with different sizes and/or installation pitches may be provided.

What is claimed is:

1. A boiler comprising:

a plurality of inner heat-transfer tubes arrayed cylindrically between an upper header and a lower header and making up an inner heat-transfer tube row;

a plurality of outer heat-transfer tubes arrayed cylindrically between the upper header and the lower header so as to surround the inner heat-transfer tube row and making up an outer heat-transfer tube row;

inner fins provided so as to project from each of the inner heat-transfer tubes on an outer circumferential side of the cylindrical inner heat-transfer tube row;

outer fins provided so as to project from each of the outer heat-transfer tubes on an inner circumferential side of the cylindrical outer heat-transfer tube row;

an inner row communicating portion provided in a lower end portion of the inner heat-transfer tube row, and communicating an inside and an outside of the inner heat-transfer tube row;

an outer row communicating portion provided in an upper end portion of the outer heat-transfer tube row, and communicating an inside and an outside of the outer heat-transfer tube row;

an inner-fin absent region that is a region where the inner fins are absent, and is provided in a lower end portion of each of the inner heat-transfer tubes and up to a portion above an upper end of the inner row communicating portion; and an outer-fin absent region that is provided in a longitudinally middle portion of each of the outer heat-transfer tubes, and is a region where the outer fins are absent, the longitudinally middle portion being arranged at a height corresponding to the upper end of the inner row communicating portion.

2. The boiler according to claim 1, wherein the inner-fin absent region is a height region corresponding to the inner row communicating portion and a region above the upper end of the inner row communicating portion by a first set distance, the first set distance is a distance 2 to 10 times an installation pitch of the inner fins in a bottom portion, the outer-fin absent region is a region above the height corresponding to the upper end of the inner row communicating portion by a second set distance, and a region shorter than the second set distance therebelow, and the second set distance is a distance 2 to 10 times an installation pitch of the outer fins in a bottom portion.

3. The boiler according to claim 2, wherein the inner heat-transfer tubes are each provided with a small-diameter portion in the lower end portion, and outer circumferential surfaces of the adjacent inner heat-transfer tubes, excluding sections of the small-diameter portions, are brought into contact with each other, in the outer heat-transfer tubes, a clearance between the adjacent outer heat-transfer tubes, excluding the upper end portions, is occluded by an occlusion fin along a longitudinal direction, the inner fins are provided so as to be inclined upward along a circumferential direction of the inner heat-transfer tube row, the outer fins are provided so as to be inclined upward along a circumferential direction of the outer heat-transfer tube row, and in the inner fins and the outer fins, a projection length thereof from each of the heat-transfer tubes is set to be smaller in a lower region of the heat-transfer tube than that in an upper region, and in a region with the same projection length, the installation pitch is set to be larger in the lower region of the heat-transfer tube than that in the upper region.

4. The boiler according to claim 3, wherein an installation region of the inner fins in each of the inner heat-transfer tubes and an installation region of the outer fins in each of the outer heat-transfer tubes are each divided into a first region, a second region, a third region and a fourth region from bottom to top, the projection length of the inner fins and the outer fins in the first regions and the second regions is set to be smaller than the projection length in the third regions and the fourth regions, the installation pitch of the inner fins and the outer fins in the first regions and the third regions is set to be larger than the installation pitch in the second regions and the fourth regions, the inner-fin absent region is provided below the first region in each of the inner heat-transfer tubes, and the outer-fin absent region is provided in a vertically middle portion of the first region in each of the outer heat-transfer tubes.

* * * * *